US009787008B2

(12) United States Patent
Gou et al.

(10) Patent No.: US 9,787,008 B2
(45) Date of Patent: Oct. 10, 2017

(54) CABLE END CONNECTOR AND METHOD MAKING THE SAME

(71) Applicant: ALLTOP ELECTRONICS (SUZHOU) LTD., Taicang, JiangSu Province (CN)

(72) Inventors: Ya-Juan Gou, Taicang (CN); Zhi-Qiang Rong, Taicang (CN); Li-Ii Liang, Taicang (CN); Mao-Jung Huang, New Taipei (TW); Wang-I Yu, New Taipei (TW)

(73) Assignee: ALLTOP ELECTRONICS (SUZHOU) LTD., Taicang (CN)

( * ) Notice: Subject to any disclaimer, the term of this patent is extended or adjusted under 35 U.S.C. 154(b) by 0 days.

(21) Appl. No.: 15/353,330

(22) Filed: Nov. 16, 2016

(65) Prior Publication Data

US 2017/0149153 A1 May 25, 2017

(30) Foreign Application Priority Data

Nov. 19, 2015 (TW) ..... 104138353 A
Jan. 20, 2016 (TW) ..... 105101712 A

(51) Int. Cl.

| | |
|---|---|
| ***H01R 13/6585*** | (2011.01) |
| ***H01R 13/6592*** | (2011.01) |
| ***H01R 12/53*** | (2011.01) |
| ***H01R 24/60*** | (2011.01) |
| ***H01R 13/6582*** | (2011.01) |
| ***H01R 43/02*** | (2006.01) |
| ***H01R 43/24*** | (2006.01) |
| ***H01R 43/20*** | (2006.01) |

(Continued)

(52) U.S. Cl.
CPC ..... *H01R 12/53* (2013.01); *H01R 13/6582* (2013.01); *H01R 24/60* (2013.01); *H01R 43/0256* (2013.01); *H01R 43/205* (2013.01); *H01R 43/24* (2013.01); *H01R 43/26* (2013.01); *H01R 2107/00* (2013.01)

(58) Field of Classification Search
CPC ..... H01R 13/6585; H01R 13/6592; H01R 13/658; H01R 23/688
USPC ..... 439/607.05, 108, 607.46, 607.41, 607.47
See application file for complete search history.

(56) References Cited

U.S. PATENT DOCUMENTS 9,022,800 B2 * 5/2015 Yang ..... H01R 13/6581 439/487
9,231,356 B1 * 1/2016 Ju ..... H01R 24/78

(Continued)

*Primary Examiner* — Gary Paumen
(74) *Attorney, Agent, or Firm* — Sughrue Mion, PLLC

(57) ABSTRACT

A USB cable end connector and the method of making the same are disclosed. The cable end connector includes a first contact module, a second contact module, a central grounding unit sandwiched between the two contact modules, a shielding shell enclosing the first and the second contact modules; and a grounding means attached to the first and the second contact modules along a height direction of the connector. The grounding means includes an upper grounding pad and a lower grounding pad. The upper grounding pad and the lower grounding pad are assembled to a first and a second insulators of the contact modules along a height direction, respectively. The upper grounding pad is sandwiched between the first contact module and the shielding shell. The lower grounding pad is sandwiched between the second contact module and the shielding shell.

20 Claims, 12 Drawing Sheets

(51) Int. Cl.
*H01R 43/26* (2006.01)
*H01R 107/00* (2006.01)

(56) References Cited

U.S. PATENT DOCUMENTS

| | | | | |
|---|---|---|---|---|
| 9,300,095 | B2 * | 3/2016 | Lin | H01R 24/60 |
| 9,450,337 | B2 * | 9/2016 | Kao | H01R 13/6461 |
| 9,450,341 | B2 * | 9/2016 | Kao | H01R 13/6585 |
| 9,461,412 | B2 * | 10/2016 | Yu | H01R 13/6585 |
| 9,461,415 | B2 * | 10/2016 | Guo | H01R 13/41 |
| 9,484,677 | B2 * | 11/2016 | Guo | H01R 13/6585 |
| 2015/0244111 | A1 * | 8/2015 | Ju | H01R 13/6585 439/607.05 |
| 2016/0020560 | A1 * | 1/2016 | Ju | H01R 24/78 439/607.05 |
| 2016/0149348 | A1 * | 5/2016 | Kao | H01R 13/6585 439/607.05 |
| 2016/0149350 | A1 * | 5/2016 | Kao | H01R 24/60 439/607.05 |

* cited by examiner

CABLE END CONNECTOR AND METHOD MAKING THE SAME

BACKGROUND

1. Technical Field

The present disclosure relates to an electrical connector, and more particularly to a Universal Serial Bus (USB) cable end connector with grounding means for mounting onto a printed circuit board.

2. Description of Related Art

The USB-IF announced USB Type-C™ standards in 2014. This kind of connector of USB Type-C™ features double-direction insertions. In the same time, the transmission rate and shielding performance are improved. This type of connector requires a high signal transmission quality which needs to employ grounding means for grounding purpose.

Hence, there is a need to provide a Universal Serial Bus connector with improved grounding means.

SUMMARY

The present disclosure includes a Universal Serial Bus cable end connector pluggable with a complementary connector. The cable end connector comprises a first contact module, a second contact module, a central grounding unit sandwiched between the first and the second contact modules, a shielding shell, and a grounding means attached to the first contact module and the second contact module along a height direction of the connector. The first contact module comprises a plurality of first contacts and a first insulator retaining the first contacts. Each of the plurality of first contacts comprises a first fastening portion assembled in the first insulator, a first contacting portion extending from the first fastening portion, and a first tail portion extending from the first fastening portion opposite to the first contacting portion. The second contact module comprises a plurality of second contacts and a second insulator retaining the second contacts. Each of the plurality of second contacts comprises a second fastening portion assembled in the second insulator, a second contacting portion extending from the second fastening portion, and a second tail portion extending from the second fastening portion opposite to the second contacting portion. The central grounding unit comprises a central grounding pad and a pair of grounding locking arms extending at opposite sides of the central grounding pad. The central grounding pad is sandwiched between the first and the second insulators. The shielding shell encloses the first and the second contact modules. The grounding means comprises an upper grounding pad and a lower grounding pad. The upper grounding pad and the lower grounding pad are assembled to the first and the second insulator along a height direction, respectively. The upper grounding pad is sandwiched between the first contact module and the shielding shell. The lower grounding pad is sandwiched between the second contact module and the shielding shell.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The components in the drawing are not necessarily drawn to scale, the emphasis instead being placed upon clearly illustrating the principles of the described embodiments. In the drawings, reference numerals designate corresponding parts throughout various views, and all the views are schematic.

DETAILED DESCRIPTION OF THE ILLUSTRATED EMBODIMENT

Figure 1:
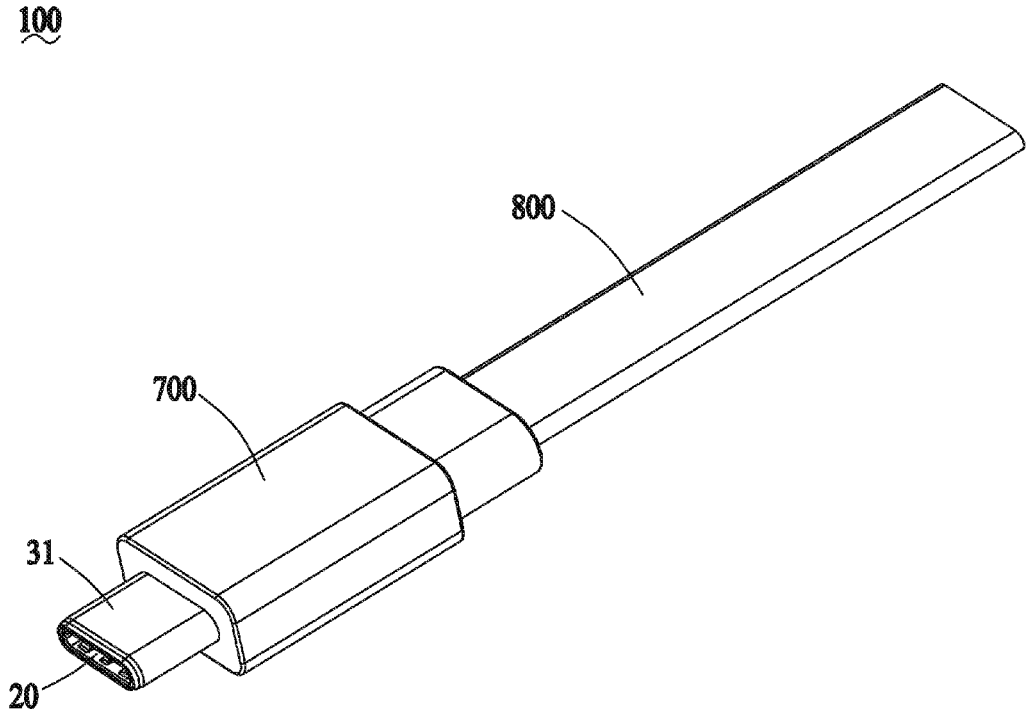
FIG. 1 is a perspective view of a cable connector assembly in accordance with the present invention.

Reference will now be made to the drawing figures to describe the embodiments of the present disclosure in detail. In the following description, the same drawing reference numerals are used for the same elements in different drawings.

Figure 2:
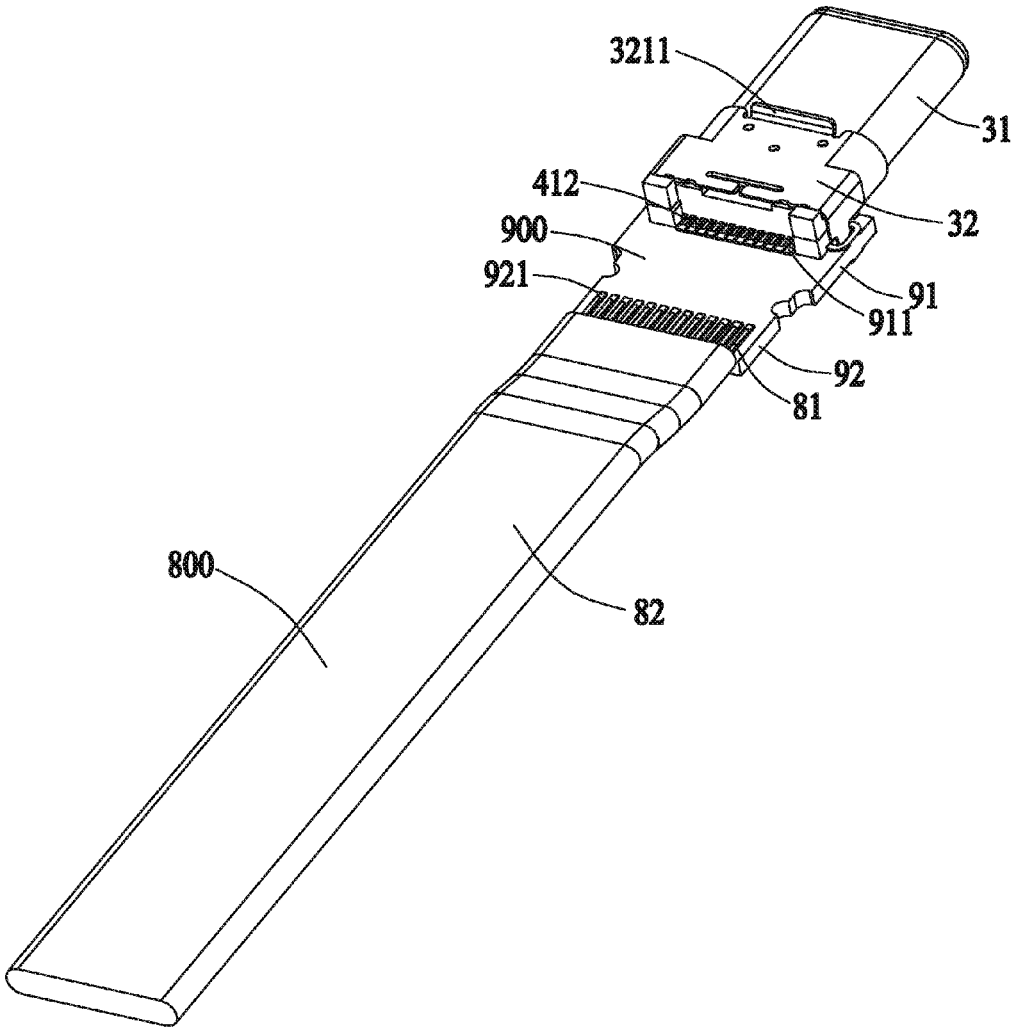
FIG. 2 is a perspective view of the cable connector assembly as shown in FIG. 1, from which a sleeve is removed.
Figure 3:
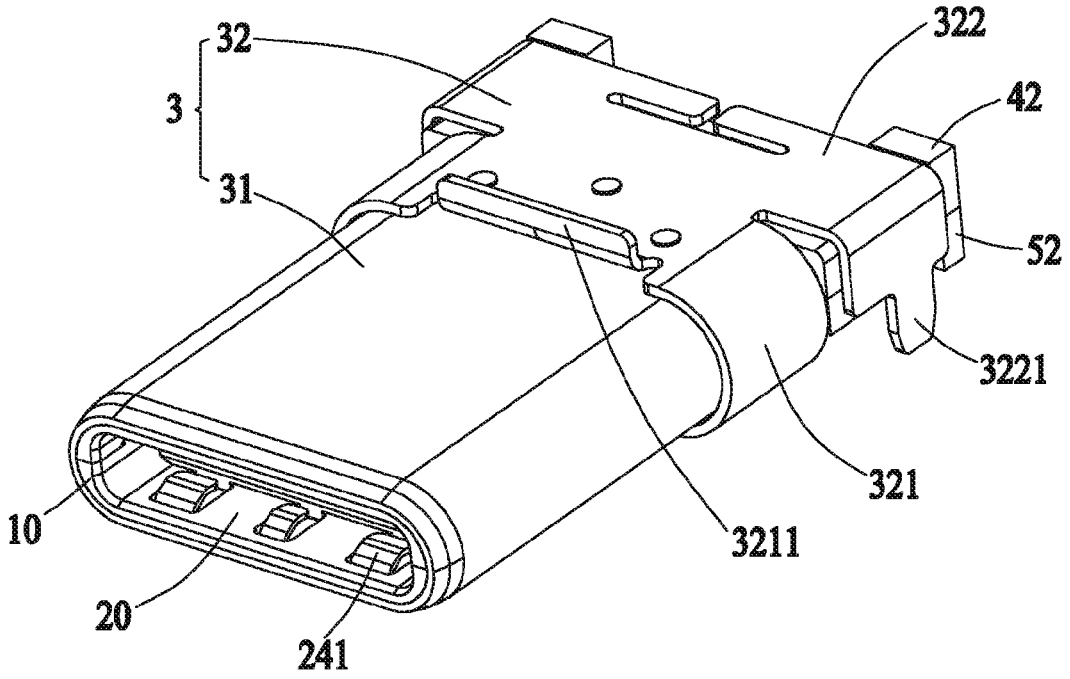
FIG. 3 is a perspective view of a cable end connector as shown in FIG. 1.

Referring to FIGS. 1 and 2, an illustrated embodiment of the present invention discloses a cable end electrical connector 100 which complies to standard USB Type-C™. The cable end electrical connector or the USB connector 100 is employed to engage with a complementary connector (not shown). The connector 100 electrically connects with a cable 800 by a circuit board 900. The connector 100, the circuit board 900, a sleeve 700 encased therein a rear part of the connector 100, and the cable 800 together form a cable connector assembly. The connector 100 includes a contact subassembly 1, a shielding shell 3 enclosing the contact subassembly 1 and a grounding means 2 electrically connecting with the shielding shell 3.

The contact subassembly 1 includes a first contact module 4, a second contact module 5, a central grounding unit 6, and an insulating inserter 7. The first contact module 4 and the second contact module 5 are assembled together along an up-to-down direction or a height direction. The central grounding unit 6 is positioned between the first and the second contact modules 4, 5. The insulating inserter 7 is employed to firmly connect the first contact module 4, the second contact module 5 and the central grounding unit 6 together. It should be noted here that the insulating inserter 7 can be removed by other means which can also connect together the first and the second contact modules 4, 5.

Turning to FIGS. 3-8, the first contact module 4 has a plurality of first contacts 41 and a first insulator 42 securing the plurality of first contacts 41. The first contacts 41 each have a first fastening portion 410 assembled in the first insulator 42, a first contacting portion 411 extending from one end of the first fastening portion 410 and a first tail portion 412 extending from an opposite end of the first fastening portion 410 for soldering on the printed circuit board 900. In this preferred embodiment, the first contacts 41 are arranged in one row and insert-molded within the first insulator 42. The first tail portion 412 extends downwards from the first fastening portion 410 and towards the printed circuit board 900 along a horizontal direction to thereby soldered thereto. The first tail portions 412 are transversally positioned in one row.

The second contact module 5 has a plurality of second contacts 5 and a second insulator 52 securing the second plurality of second contacts 5. The second contacts 51 each have a second fastening portion 510 assembled in the second insulator 52, a second contacting portion 511 extending from one end of the second fastening portion 510 and a second tail portion 512 extending from an opposite end of the second fastening portion 510. In this preferred embodiment, the second contacts 51 are arranged in one row and insert-molded within the second insulator 52. The second tail portion 512 perpendicularly extends downwards from the second fastening portion 510 and towards the printed circuit board 900. The second tail portions 512 are arranged in two staggered rows.

The first contacts 41 and the second contacts 51 each comprise two grounding contacts 43, two pairs of differential pairs 44, two power contacts 45 and a pair of signal contacts 46 positioned between the two power contacts 45. Such an arrangement of the first contacts 41 and the second contacts 51 are meeting with the standard connector of USB Type-C™.

The first insulator 42 comprises a first tongue section 421 and a first assembling section 422 connecting with the first tongue section 421. The dimensions of the first tongue section 421 is smaller than the dimensions of the first assembling section 422 either from an upper-to-down direction or a left-to-right direction. A first recess 4211 is defined between an intersection of the first tongue section 421 and the first assembling section 422. The first recess 4211 extends throughout the first insulator 42 for providing space to the die (not shown). The first tongue section 421 forms an outer surface 4212 confronting the shielding shell 3 and an inner surface 4213 confronting the central grounding unit 6. A positioning hole 4214 is recessed from the inner surface 4213 and a positioning post 4215 is formed oppositely.

The second insulator 52 includes a second tongue section 521 and a second assembling section 522 connecting with the second tongue section 521. The dimensions of the second tongue section 521 is smaller than the dimensions of the second assembling section 522 either from an upper-to-down direction or a left-to-right direction. An engaging space 20 is defined by forward ends of the first and the second tongue sections 421, 521 to thereby receiving the contacting portions 411, 511. A pair of engaging cutouts 5215 are respectively formed in the forward ends of the first tongue section 421 and the second tongue section 521. Correspondingly, a pair of engaging blocks 5214 which can be blocked in corresponding engaging cutouts 5215, are formed respectively in the forward ends of the first tongue section 421 and the second tongue section 521. Similarly, the second tongue section 521 defines an outer face 5212 confronting the shielding shell 3 and an inner face 5213 confronting the central grounding unit 6. A second recess 5211 is also recessed from the inner face 5213. The first contact module 4 and the second contact module 5 are fixedly assembled together by the engagements between the positioning posts 4215 with the positioning holes 4214, the engaging cutouts 5215 with the engaging blocks 5214 with the central grounding unit 6 sandwiched between the first and the second contact modules 4, 5. It can be understood that the shapes and the configurations of the above-described engageable members are changeable according to different requirements. In order to avoid wrongly assembly of the central grounding unit 6, in the preferred embodiment, a cross section of one of the positioning post 4215 is formed in circular type and a cross section of the other positioning post 4215 is formed in rectangular shape. A receiving recess 5221 is defined on the second assembling section 522 for providing space for the printed circuit board 900. A pair of protrusions 5222 is formed on the receiving recess 5221 for securing to the printed circuit board 900.

Figure 4:
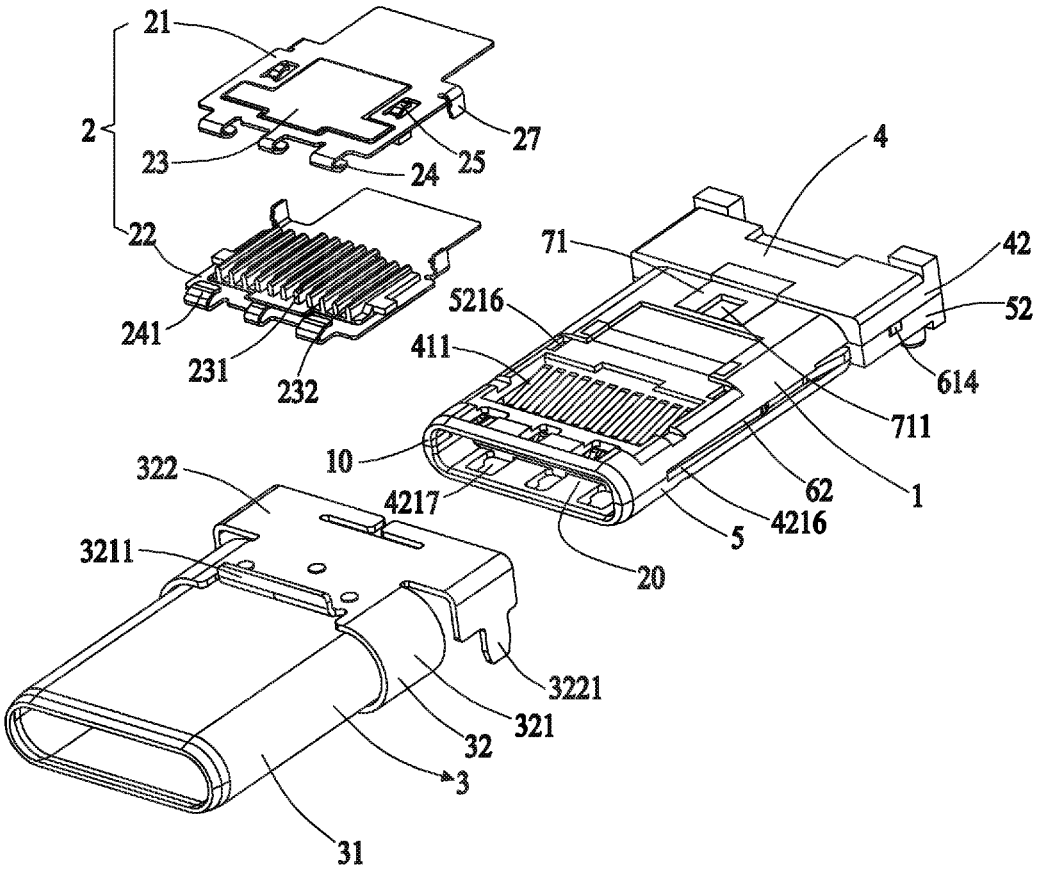
FIG. 4 is a partially exploded, perspective view of the cable end connector as shown in FIG. 3.
Figure 5:
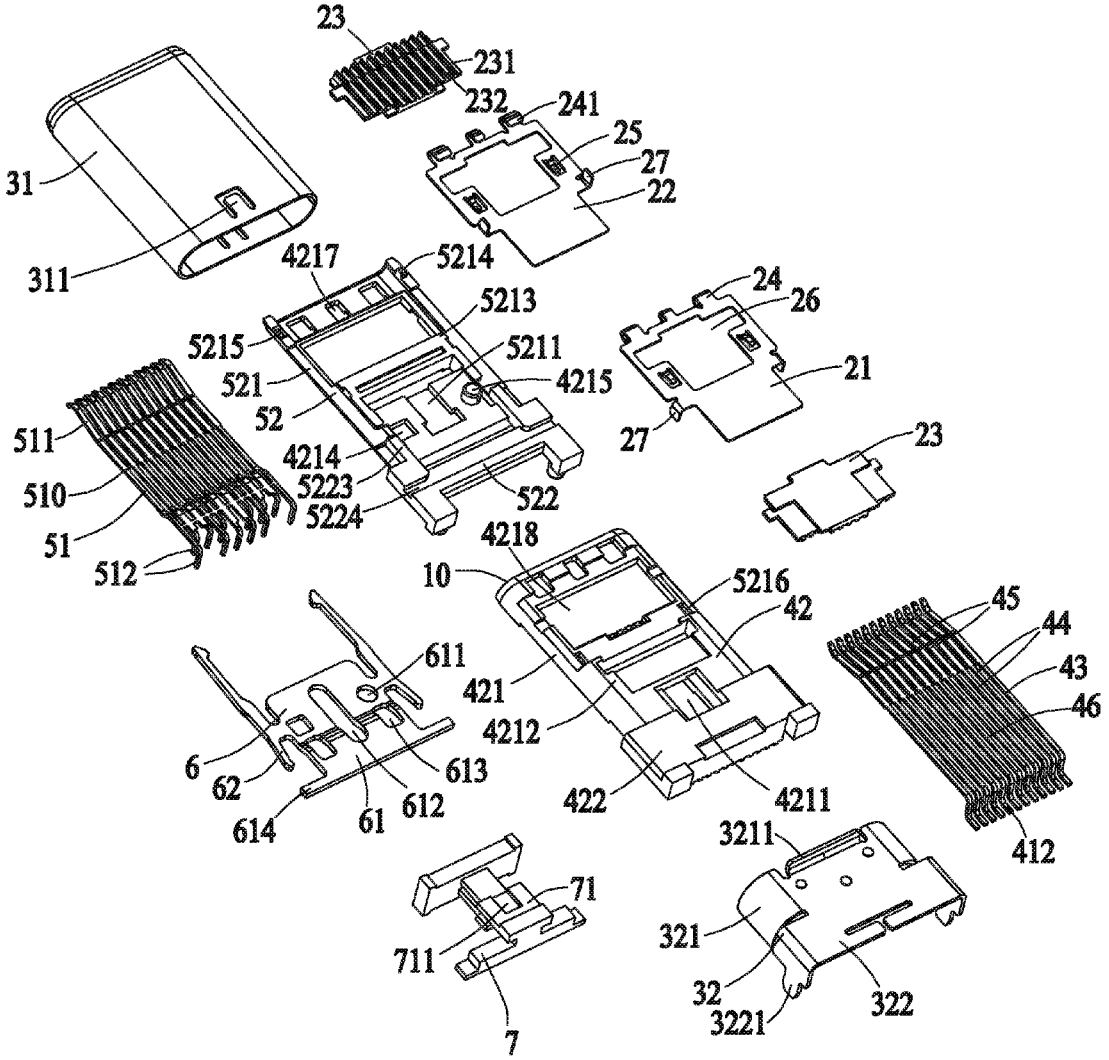
FIG. 5 is an exploded, perspective view of the cable end connector as shown in FIG. 4.
Figure 6:
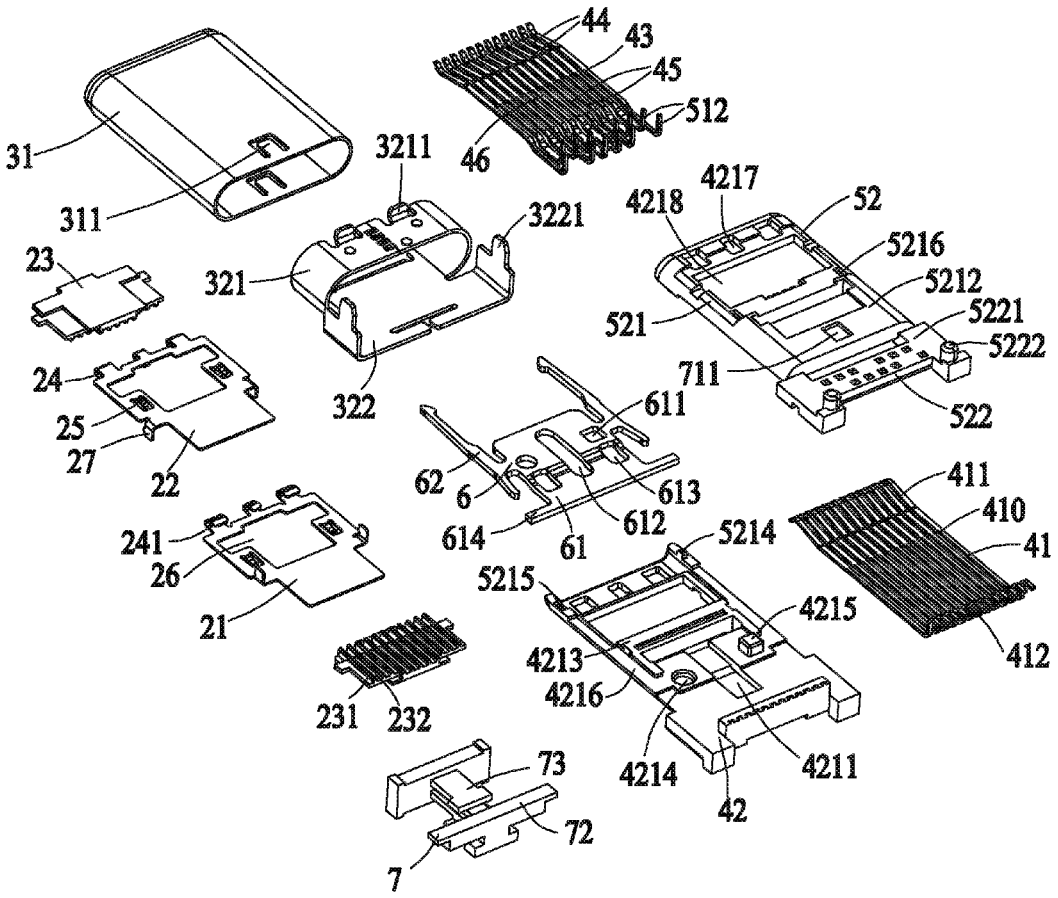
FIG. 6 is an exploded, perspective view of the cable end connector as shown in FIG. 5, while taken from another aspect.
Figure 7:
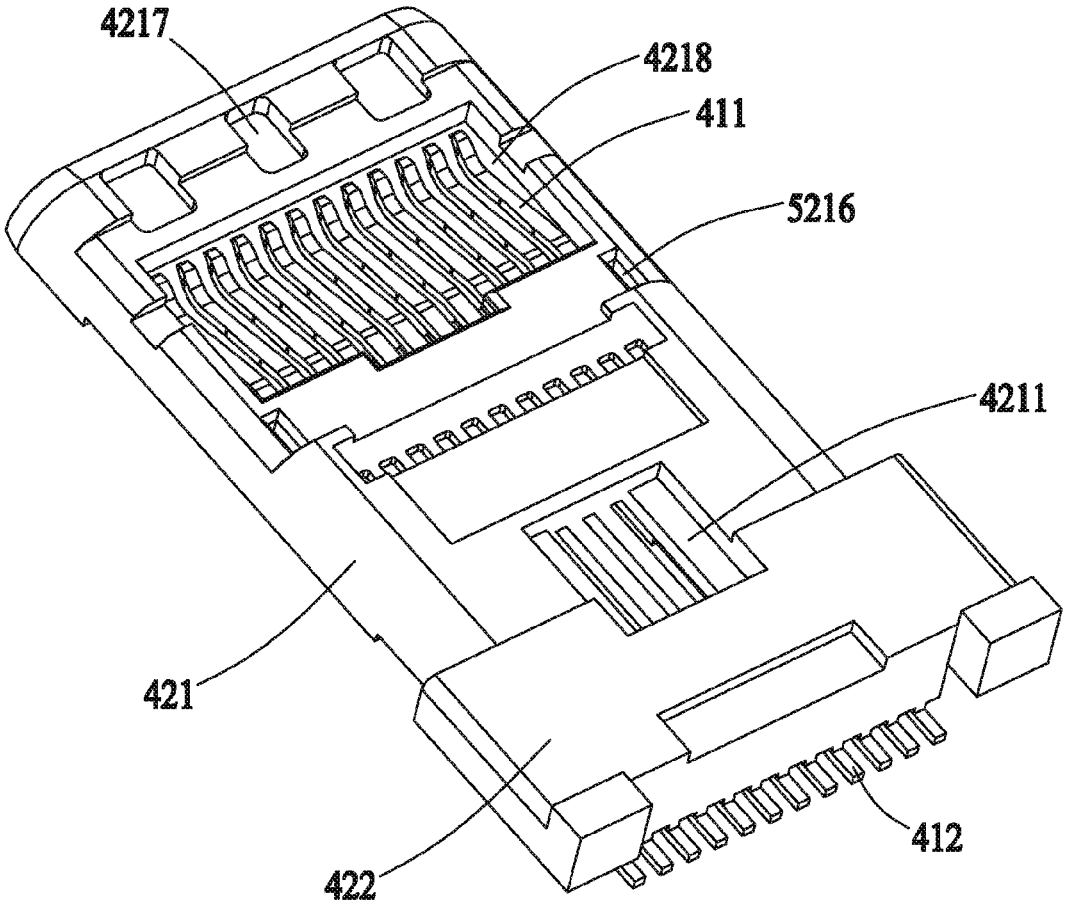
FIG. 7 is a perspective view of an assembled first contact module shown in FIG. 5.
Figure 8:
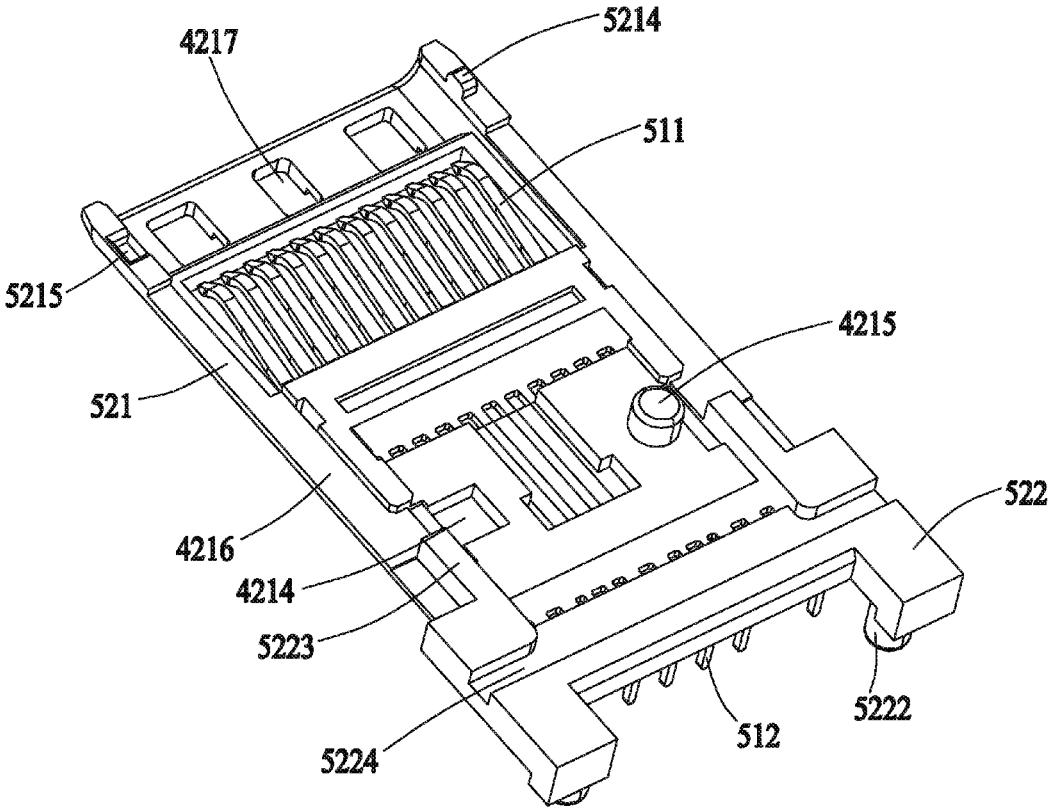
FIG. 8 is a perspective view of an assembled second contact module shown in FIG. 5.

Referring to FIGS. 4-6, the central grounding unit 6 comprises a central grounding pad 61 and a pair of grounding locking arms 62 located at opposite sides of the central grounding pad 61. The central grounding pad 61 is fixed between the first insulator 42 and the second insulator 52. The pair of grounding locking arms 62 extend parallel with the contacting portions 411, 511. A pair of positioning holes 611, an elongated hole 612 located between the pair of positioning holes 611, and a pair of rectangular holes 613 besides the pair of positioning holes are defined throughout the grounding pad 61. The pair of positioning holes 611 are used to engage with the positioning posts 4215. The first recess 4211 communicates with the second recess 5211 via the elongated hole 612. In this preferred embodiment, the central grounding pad 61 forms a pair of transversal arms 614 extending along a width direction of the connector and connecting to the shielding shell 3. The grounding locking arms 62 also connects to the shielding shell 3, so that the electrical connection between the central grounding unit 6 and the shielding shell 3 is established.

The second assembling section 522 forms a pair of blocks 5223 for engaging with the central grounding pad 61 and defines an engaging groove 5224 for receiving the transversal arms 614. A pair of receiving grooves 4216 is defined on the first/second tongue portion 421/521 for correspondingly receiving the grounding locking arms 62. After partial assembly of the first tongue section 421 and the second tongue section 521, the grounding locking arm 62 is exposed to the outside through the receiving groove 4216, as can be seen from FIG. 4.

The insulating inserter 7 is insert-molded in the first recess 4211, the second recess 5211, the elongated hole 612 and the rectangular hole 613, respectively, so that the first insulator 42, the second insulator 51 and the central grounding unit 6 are connected firmly. The insulating inserter 7 forms a first retaining portion 71 insert-molding within the first insulator 42, a second retaining portion 72 insert-molding within the second insulator 52, and a third retaining portion 73 insert-molding within the central grounding pad 61. The first, the second and the third retaining portions 71, 72, 73 interconnect with each other and together make the insulating inserter 7 in a substantial I-shape.

Figure 10:
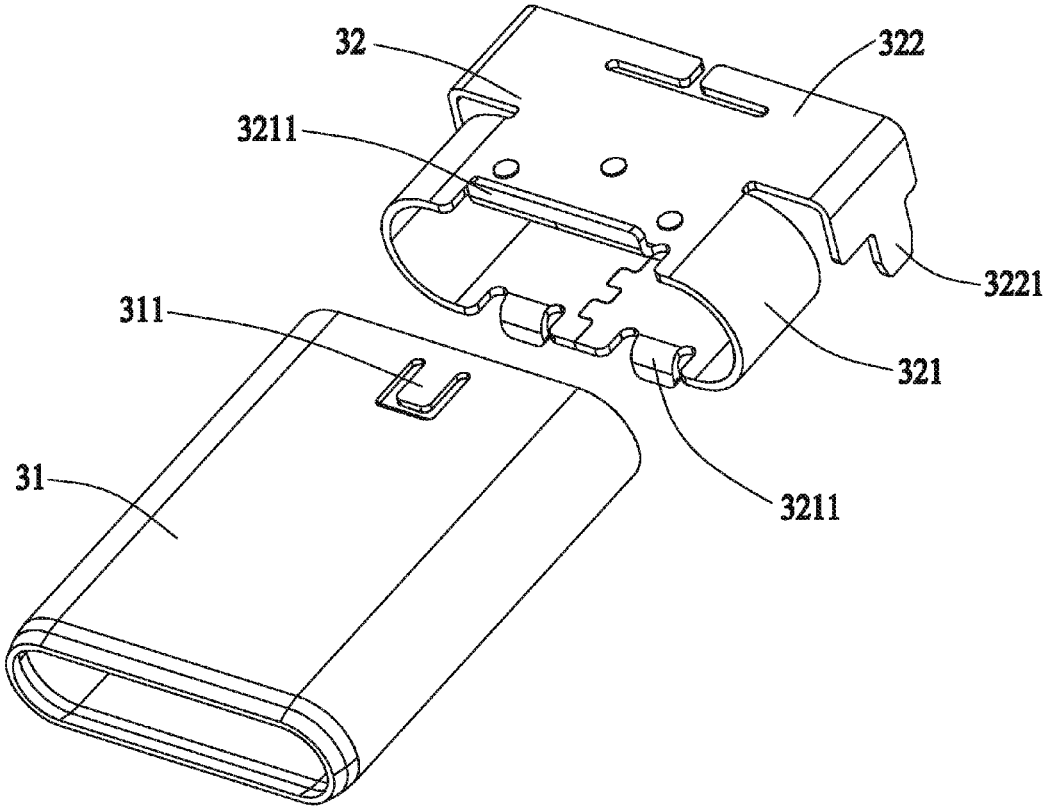
FIG. 10 is an exploded, perspective view of a shielding shell shown in FIG. 5.
Figure 11:
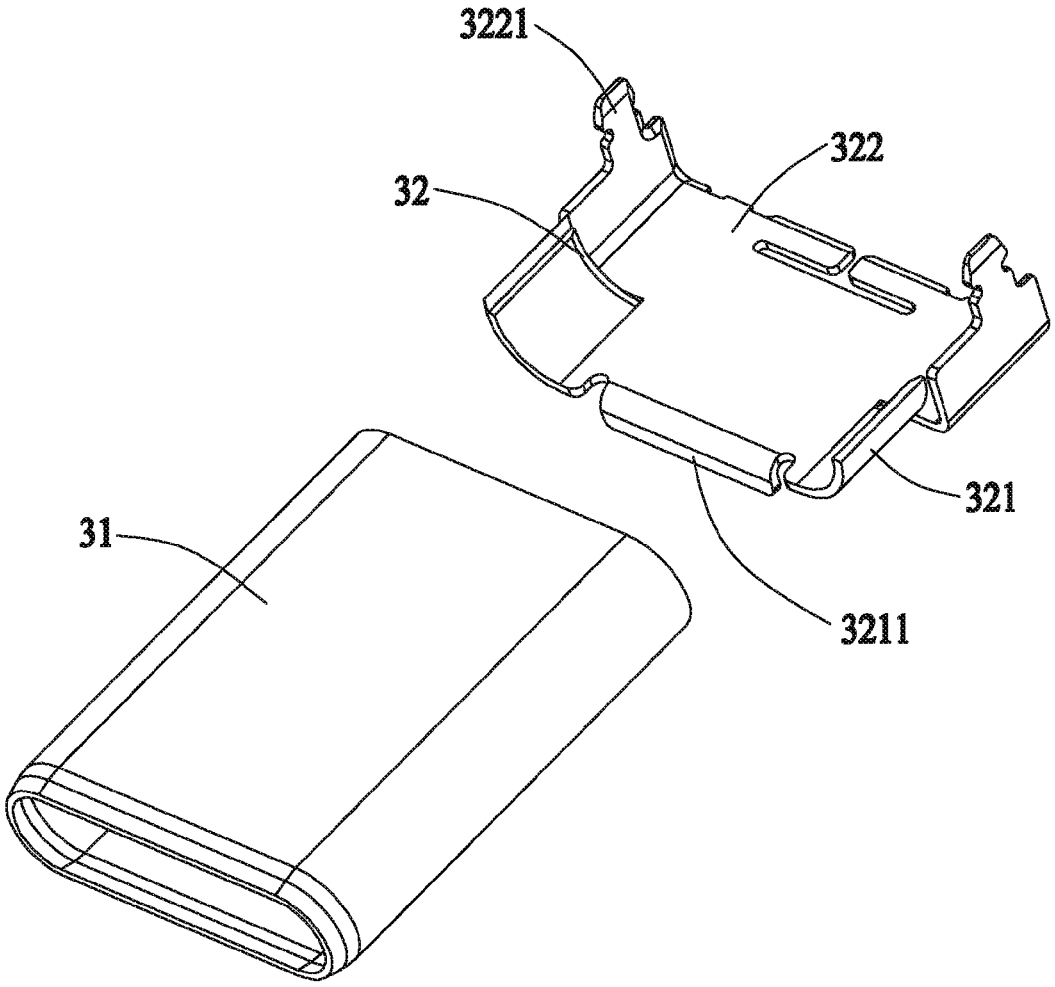
FIG. 11 is an exploded, perspective view of the shielding shell of another embodiment.

Referring to FIG. 10, the shielding shell 3, enclosing the first contact module 4 and the second contact module 5, comprises a front shell 31 and a rear shell 32 partially overlapped with and covering a rear part of the front shell 31. In details, the front shell 31 encloses entirely the first and the second tongue sections 421, 521 together with the central grounding unit 6 and the grounding means 2. The rear shell 32 encloses the first and the second assembling sections 422, 522. The grounding locking arms 62 contact to the inner face of the front shell 31 and the transversal arms 614 contact to the inner face of the rear shell 32. The inner shell 31 is integrally formed from one piece of metal material and has an elliptical cross-section. A pair of resilient tabs 311 is formed on opposite sides of the front shell 31 at a rear end thereof. Both the first retaining portion 71 of the insulating inserter 7 and the second tongue section 521 have a depression 711 recessed therefrom for cooperating with the resilient tabs 311 correspondingly to protect the front shell 31 from undesired displacement and breaking off from the first and the second insulators 42, 52.

The rear shell 32 includes a first shielding section 321 assembled to the rear side of the front shell 31 and a second shielding section 322 enclosing the first assembling section 422 and the second assembling section 522. The first shielding section 321 forms a plurality of front erecting edges 3211 at opposite upper and lower sides thereof to reinforce the whole strength during insert-molding. A plurality of solder tails 3221 are provided at respective opposite sides of the second shielding section 322 to soldering the outer shell 32 to the printed circuit board 900. The shape of the first shielding section 321 of the rear shell 32 is substantially identical to the shape of the front shell 31 to thereby facilitate soldering between these two shells 31, 32.

Referring to FIGS. 4-8, the grounding means 2 comprises an upper grounding pad 21 above the central grounding unit 6 and a lower grounding pad 22 below the central grounding unit 6. The grounding means 2 also comprises two spacers 23 assembled with the upper grounding pad 21 and the lower grounding pad 22, respectively. The upper grounding pad 21 is assembled to the first contact module 4 along a height direction of the connector and the lower grounding pad 22 is assembled to the second contact module 5 along the height direction while opposite to the upper grounding pad 21. The upper grounding pad 21 is coplanar with the outer surface 4212 and the lower grounding pad 22 is coplanar with the outer face 5212. The spacer 23 has one surface coplanar with corresponding upper/lower grounding pad. The upper grounding pad 21 and the lower grounding pad 22 each provide a plurality of inwards resisting tabs 24 and a plurality of outwards resisting tabs 25. The outwards resisting tabs 25 resiliently and electrically contact with the front shell 31. The inwards resisting tabs 24 are formed at a front end of the grounding means 2. Each of the inwards resisting tabs 24 has a substantial U-shaped cross-section. In other words, each inwards resisting tab 24 has a U-shaped head 241. The first tongue section 421 and the second tongue section 521 each define a plurality of holes 4217 for correspondingly receiving the inwards resisting tabs 24, and a space 4218 for receiving the spacer 23. The upper/lower grounding pad 21, 22 defines a window 26 between the inwards resisting tabs 24 and the outwards resisting tabs 25. The windows 25 are configured to communicate with the spaces 4218. The spacer 23 is received in the space through the window 26. The spacer 23 forms a plurality of elongated protrusions 231 along a front-to-back direction and defines a plurality of elongated slots 232 between the elongated protrusions 231. The elongated slots 232 are provided for receiving and positioning corresponding first and second contacting portions 411, 511. In this preferred embodiment, the spacers 23 are employed to isolate the first contacts 41 and the second contacts 51 from the front shell 31, during the first contacting portions 411 and the second contacting portions 511 rotate to engage with the complementary connector. A pair of fixing tabs 27 are provided on opposite sides of both the upper grounding pad 21 and the lower grounding pad 22. A pair of fixing slits 5216 are defined on the both the first tongue section 421 and the second tongue section 521 for correspondingly receiving the fixing tabs 27. The fixing tab 27 and the outwards resisting tabs 25, which are stamped from the upper/lower grounding pad, extend in different planes.

Figure 9:
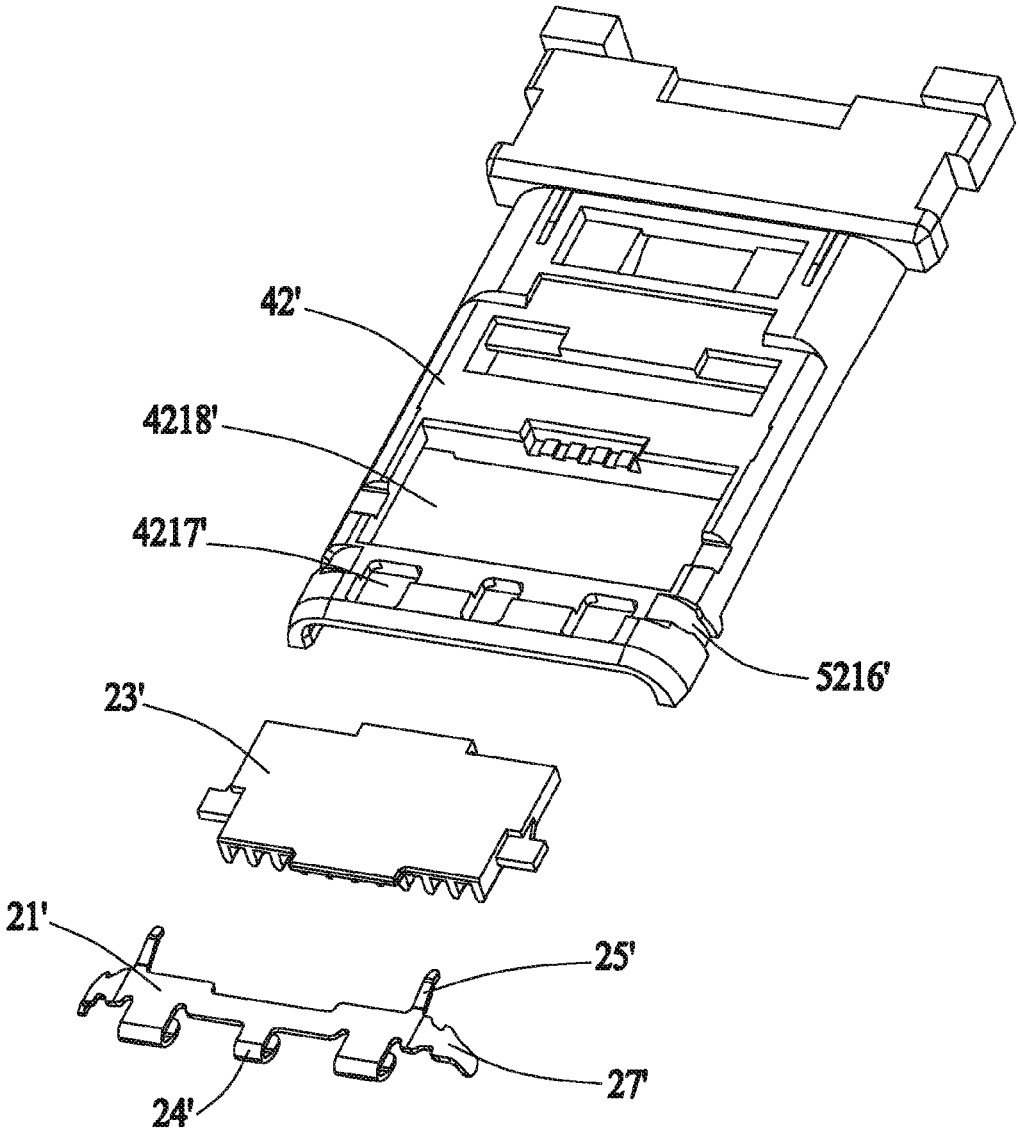
FIG. 9 is a perspective view of a grounding means of another embodiment as shown in FIG. 4.

In the preferred embodiment, the spacer 23 is insert-molded with the upper/lower grounding pad 21/22. While, in other conditions, the spacer can be formed separately with respect to the upper/lower grounding pad 21/22. As shown in FIG. 9, a different embodiment of the spacer and the grounding pad is illustrated. Taking the first insulator 42' and the upper grounding pad 21' for example, the removable spacer 23' retained in the space 4218' is assembled with the upper grounding pad 21' with the inwards resisting tabs 24' protruding into the holes 4217', the fixing tab 27 inserted into the fixing slit 5216'.

Figure 12:
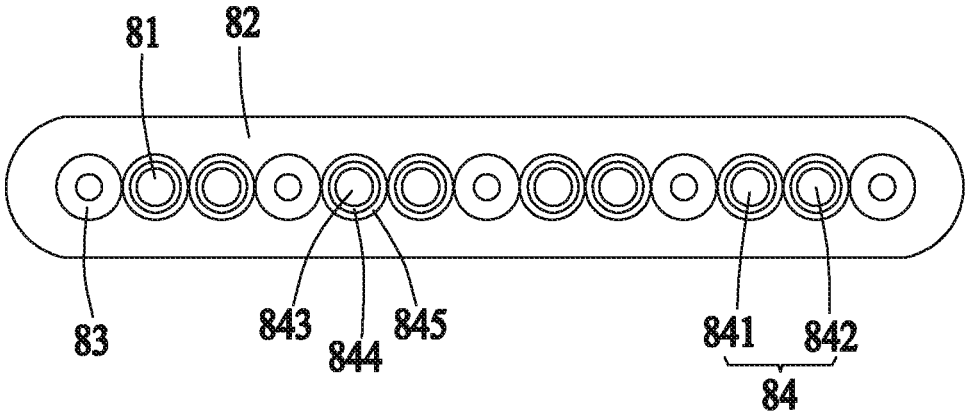
FIG. 12 is a cross-sectional view of a ribbon cable of the cable end connector assembly as shown in FIG. 1.

Referring to FIGS. 2 and 12, the printed circuit board 900 comprises front end 91 and rear end 92. The front end 91 is used to solder with the first contacts 41 and the second contacts 51. The rear end 92 is used to solder with the ribbon cable 800. A width of the rear end 92 is smaller than that of the front end 91. A plurality of first golden fingers 911 are positioned on the front end 91 and a plurality of second golden fingers 912 are positioned on the rear end 92. The first golden fingers 911 connect with the first tail portions 412 and the second tail portions 512, respectively. The ribbon cable 800 comprises a plurality of wires 81 connecting with the second golden fingers 921 and an insulating layer 82 covering the wires 81. Some of the wires 81 are used for differential pairs. The differential pair wires 84 includes a first wire 841 and a second wire 842, the phases of the transmitted signals of which are different. Each wire 84 comprises an inner conductor 843, an outer shielding 844 and the outer sleeve 845.

Subsequently, the method of manufacturing the cable end connector 100 comprises following steps: providing a first contact module, which comprises a first insulator and a plurality of first contacts secured onto the first insulator; providing a second contact module, which comprises a second insulator and a plurality of second contacts secured onto the second insulator; providing a central grounding unit and sandwiching the central grounding pad between the first and the second insulators; insert-molding an insulating inserter onto the first contact module, the second contact module and the central grounding unit; providing a grounding means, which comprises an upper grounding pad and a lower grounding pad; assembling the upper grounding pad to the first contact module along a height direction and assembling the lower grounding pad to the second contact module along the height direction while opposite to the upper grounding pad; and finally providing a shielding shell enclosing the first and the second contact modules. Understandably, in the end, the connector 100 will be soldered to the printed circuit board and the cable and covered with the sleeve 700.

In conclusion, a simply assembled grounding means 2 is used in the cable end connector 100 of the present invention. The grounding means 2 is attached to the first contact module 4 and the second contact module 5 along a height direction of the connector, which protect the first contacts 41 and the second contacts 51 from short-cutting with the shielding shell 3. On the other hand, the shielding shell 3 is designed to have two co-worked, front shell 31 and the rear shell 32 and the two shells 31, 32 can be soldered together. Consequently, the strength of the whole shielding shell 3 is enhanced. In addition, the subassembly of the first/second contacts 41, 51 and the first/second insulators 42, 52, and the subassembly of the upper/lower grounding pads 21, 22 and the insulating inserters 23, are firstly finished before such sub-assemblies assembling to other parts of the connector 100, which makes the method of manufacturing more simple.

It is to be understood, however, that even though numerous characteristics and advantages of preferred and exemplary embodiments have been set out in the foregoing description, together with details of the structures and functions of the embodiments, the disclosure is illustrative only; and that changes may be made in detail within the principles of present disclosure to the full extent indicated by the broadest general meaning of the terms in which the appended claims are expressed.

What is claimed is:

1. A cable end connector, comprising:

a first contact module comprising a plurality of first contacts and a first insulator retaining said first contacts, each of said plurality of first contacts comprising a first fastening portion assembled in said first insulator, a first contacting portion extending from said first fastening portion, and a first tail portion extending from said first fastening portion opposite to said first contacting portion;

a second contact module comprising a plurality of second contacts and a second insulator retaining said second contacts, each of said plurality of second contacts comprising a second fastening portion assembled in said second insulator, a second contacting portion extending from said second fastening portion, and a second tail portion extending from said second fastening portion opposite to said second contacting portion;

a central grounding unit comprising a central grounding pad and a pair of grounding locking arms extending at opposite sides of said central grounding pad, said central grounding pad sandwiched between said first and said second insulators;

a shielding shell enclosing said first and said second contact modules; and a grounding means comprising an upper grounding pad and a lower grounding pad, said upper grounding pad and said lower grounding pad assembled to said first and said second insulators along a height direction, respectively, said upper grounding pad sandwiched between said first contact module and said shielding shell, said lower grounding pad sandwiched between said second contact module and said shielding shell.

2. The cable end connector as claimed in claim 1, wherein said upper grounding pad and said lower grounding pad each providing a plurality of inwards resisting tabs and a plurality of outwards resisting tabs, said outwards resisting tabs resiliently contacting with said shielding shell.

3. The cable end connector as claimed in claim 2, wherein said grounding means comprises a pair of spacers assembled with said upper grounding pad and said lower grounding pad, respectively, and wherein each spacer defines a plurality of elongated slots receiving and positioning corresponding first or second contacting portions.

4. The cable end connector as claimed in claim 3, wherein said spacer has one surface thereof coplanar with one surface of said upper/lower grounding pad.

5. The cable end connector as claimed in claim 2, wherein said inwards resisting tab is formed at a front end of said grounding means and has a substantial U-shaped cross-section, and wherein said first and said second insulator each define a plurality of holes for correspondingly receiving said inwards resisting tabs.

6. The cable end connector as claimed in claim 2, wherein said upper/lower grounding pad has said outwards resisting tabs stamped therefrom and fixing tabs extending oppositely to said outwards resisting tabs, and wherein said outwards resisting tabs and said fixing tabs extend within different planes.

7. The cable end connector as claimed in claim 1, wherein said shielding shell comprises a front shell and a rear shell partially overlapped with said front shell, and wherein said grounding means is sandwiched between said front shell and said first/second contact module.

8. The cable end connector as claimed in claim 1, further comprising an insulating inserter assembled onto said first insulator, said second insulator and said central grounding unit to thereby connecting said first insulator, said second insulator and said central grounding unit together.

9. A method for manufacturing a cable end connector comprising following steps:

providing a first contact module, said first contact module comprising a first insulator and a plurality of first contacts secured onto said first insulator;

providing a second contact module, said second contact module comprising a second insulator and a plurality of second contacts secured onto said second insulator;

providing a central grounding unit and sandwiching said central grounding unit between said first and said second insulators;

insert-molding an insulating inserter onto said first contact module, said second contact module and said central grounding unit;

providing a grounding means comprising an upper grounding pad and a lower grounding pad;

assembling said upper grounding pad to said first contact module along a height direction and assembling said lower grounding pad to said second contact module along the height direction while opposite to said upper grounding pad; and providing a shielding shell enclosing said first and said second contact modules.

10. The method as claimed in claim 9, wherein said first contacts each forming a first fastening portion assembled in said first insulator, a first contacting portion extending from said first fastening portion, and a first tail portion extending from said first fastening portion opposite to said first contacting portion, and wherein said second contacts each forming a second fastening portion assembled in said second insulator, a second contacting portion extending from said second fastening portion, and a second tail portion extending from said second fastening portion opposite to said second contacting portion.

11. The method as claimed in claim 9, wherein said central grounding unit comprising a central grounding pad and a pair of grounding locking arms extending at opposite sides of said central grounding pad.

12. The method as claimed in claim 10, wherein said upper grounding pad and said lower grounding pad each providing a plurality of inwards resisting tabs and a plurality of outwards resisting tabs, said outwards resisting tabs resiliently contacting with said shielding shell.

13. The method as claimed in claim 12, wherein said grounding means comprises a pair of spacers assembled with said upper grounding pad and said lower grounding pad, respectively, and wherein each spacer defines a plurality of elongated slots receiving and positioning corresponding first or second contacting portions.

14. The method as claimed in claim 13, wherein said spacer has one surface thereof coplanar with one surface of said upper/lower grounding pad.

15. The method as claimed in claim 13, wherein said elongated slots are defined by a plurality of elongated protrusions protruded along a height direction of said connector.

16. The method as claimed in claim 12, wherein said inwards resisting tab is formed at a front end of said grounding means and has a substantial U-shaped cross-section, and wherein said first and said second insulators each define a plurality of holes for correspondingly receiving said inwards resisting tabs.

17. The method as claimed in claim 12, wherein said upper/lower grounding pad has said outwards resisting tabs stamped therefrom and fixing tabs extending oppositely to said outwards resisting tabs, and wherein said outwards resisting tabs and said fixing tabs extend within different planes.

18. The method as claimed in claim 9, wherein said shielding shell comprises a front shell and a rear shell partially overlapped with said front shell, and wherein said grounding means is sandwiched between said front shell and said first/second contact module.

19. A cable connector assembly, comprising:

a cable end connector comprising:

a pair of contact modules each comprising a plurality of contacts and an insulator retaining said contacts, each of said plurality of contacts comprising a fastening portion assembled in said insulator, a contacting portion extending from said fastening portion, and a tail portion extending from said fastening portion opposite to said contacting portion, said contacts transmitting at least two differential pairs of signals;

a central grounding unit substantially sandwiched between said pair of contact modules;

a shielding shell enclosing said pair of contact modules; and a grounding means comprising an upper grounding pad and a lower grounding pad, said upper grounding pad and said lower grounding pad assembled to said insulators along a height direction, respectively, said upper and lower grounding pads respectively sandwiched between said contact module and said shielding shell;

a circuit board electrically connecting with said cable end connector, and a cable connecting to said circuit board and electrically connecting to said cable end connector.

20. The cable connector assembly as claimed in claim 19, further comprising a sleeve partially encasing said cable end connector together with said circuit board and said cable.

* * * * *